US005355648A

United States Patent [19]

Graver et al.

[11] Patent Number: 5,355,648

[45] Date of Patent: Oct. 18, 1994

[54] LOCKING CLIP

[75] Inventors: Martin L. Graver, Lancaster; James F. Mathis, Columbia, both of Pa.

[73] Assignee: Armstrong World Industries, Inc., Lancaster, Pa.

[21] Appl. No.: 31,217

[22] Filed: Mar. 12, 1993

[51] Int. Cl.[5] ..... E04B 9/24

[52] U.S. Cl. ..... 52/506.08; 52/506.05; 52/506.07

[58] Field of Search ..... 52/484, 489, 490, 506.07, 52/506.08, 506.09, 779, 780, 506.05, 506.06

[56] References Cited

U.S. PATENT DOCUMENTS

| | | | |
|---|---|---|---|
| 337,829 | 3/1886 | Gilman | 52/506.05 X |
| 2,071,865 | 2/1937 | Parsons | 52/483.1 X |
| 4,568,215 | 2/1986 | Nelson | 52/506.05 X |

FOREIGN PATENT DOCUMENTS

| | | | |
|---|---|---|---|
| 523682 | 1/1993 | European Pat. Off. | 52/506.05 |
| WO91/19056 | 12/1991 | PCT Int'l Appl. | 52/506.05 |

OTHER PUBLICATIONS

ITW FASTEX Catalog, pp. 18 & 19, no date listed.

*Primary Examiner*—Carl D. Friedman
*Assistant Examiner*—Kevin D. Wilkins

[57] ABSTRACT

A corner clip is provided on the edge of a ceiling panel and the end(s) of the clip space the panel from the ceiling runner vertical web. The clip can be a right angle shape having a downwardly projecting portion which fits into a recess in the back of the ceiling panel. The clip can be a disc shape having a downwardly projecting portion which fits into a recess in the back of the ceiling panel.

5 Claims, 3 Drawing Sheets

Fig. 4
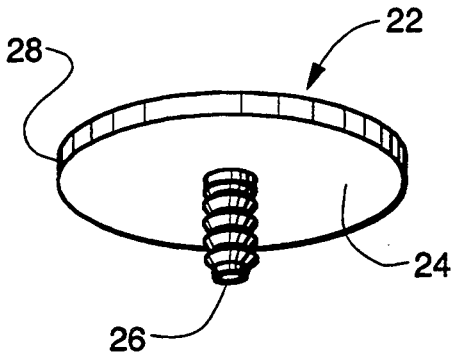
Fig. 5
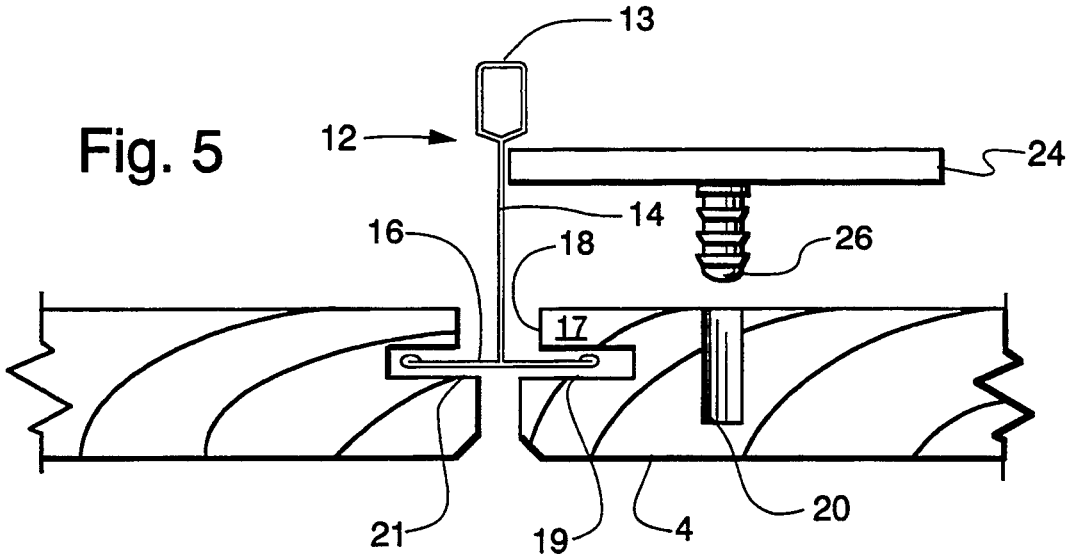
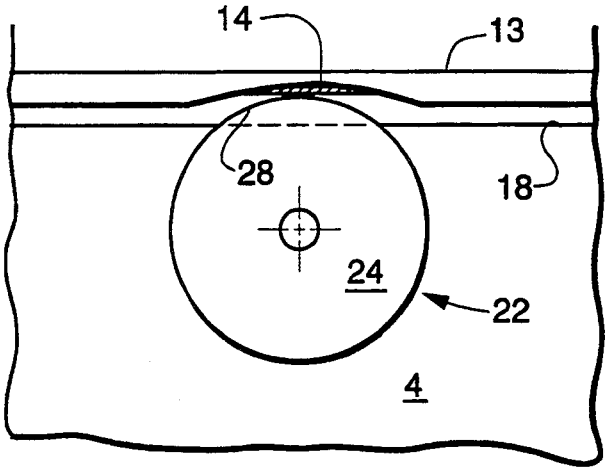
Fig. 6

LOCKING CLIP

BACKGROUND OF THE INVENTION

1. Field of the Invention

The invention is directed to a ceiling panel and, more particularly, to a clip which is provided on the edge of the ceiling panel to space the edges of the ceiling panel from the vertical webs of the runners supporting the ceiling panel and to lock the ceiling panel in position within the runners.

2. Description of the Prior Art

U.S. Pat. No. 4,712,350 discloses the use of a bump 30 on the vertical web of a runner to position a ceiling panel relative the vertical web. This structure in no way teaches or suggests the invention described below.

Summary of the Invention

The invention is directed to a corner clip for a ceiling panel in a suspended ceiling system. The corner clip is formed with a right angle shaped base with two arms. Adjacent the intersection of the two arms a ringed post projects from the base. A ceiling panel is provided within a suspended ceiling system which comprises four inverted T-shaped runners. Each runner has a flange upon which the ceiling panel may sit and a vertical web which is to be spaced from the edge of the ceiling panel. At least one corner clip is provided in a corner of the ceiling panel. A hole is provided in the corner of the ceiling panel and the post of the corner clip is pressed into the hole in the corner of the ceiling panel and the two arms of the corner clip engage adjacent vertical webs of the ceiling runners to space the edge of the ceiling panel from the edge of the vertical web of a runner.

An alternate structure can be used. A round disc clip is provided with a ringed post in the center of the disc. At least one disc is provided along one side of the ceiling panel. A hole is provided along one edge of the ceiling panel and the post of the disc is pressed into the hole. The edge of the disc engages the adjacent vertical web of the ceiling runner to space the edge of the ceiling panel from the edge of the web of the runner.

This results in the positioning of the ceiling panel in the center of the opening in the grid structure so that the ceiling panel is supported on at least two edges by the flanges of the runners, and the ceiling panel is locked in position so that it cannot shift to disengage from the flanges of the runners.

DESCRIPTION OF THE DRAWING

FIG. 4 is a perspective view of the round disc.

FIG. 5 is a cross-section view of the location of the round clip relative the ceiling panel and the ceiling runner.

FIG. 6 is a top view of the round clip in position.

DESCRIPTION OF THE PREFERRED EMBODIMENTS

Figure 1:
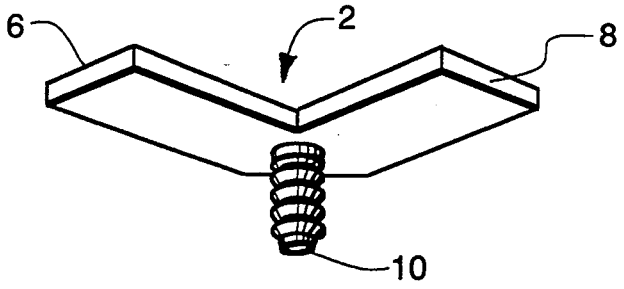
FIG. 1 is a perspective view of the corner clip.

A corner clip 2 is provided for ceiling panels which are supported in a suspended ceiling system. At least two corner clips are used on two adjacent corners of the ceiling panel. The corner clip is a flat right angle shaped base structure with two arms 6 and 8. Adjacent the intersection of the two arms a ringed post 10 projects from the base.

At least one ceiling panel 4 is provided in a suspended ceiling system. The suspended ceiling system is composed of four inverted T-shaped runners 12. Each runner has a bulb member 13, a vertical member 14 and a horizontal member 16. The ceiling panel is supported on the horizontal members of at least two opposite runners. It is desired that the ceiling panel have its edges 18 and corners spaced from the vertical web 14 of the runners. The spacing of the edges of the ceiling panel from the vertical webs locates the ceiling panel centrally of the four adjacent runners and thus insures that the ceiling panel is fully supported on at least two opposite runner horizontal flanges. In at least two adjacent corners of the ceiling panel by a panel edge supported by a runner, there is provided a hole 20 which is partly bored in the ceiling panel. Into each of the holes 20, there is inserted the ringed post 10 which will hold the corner clips in position in the corner of the ceiling panel. The arms of each corner clip contact the vertical members 14 of two adjacent runners to maintain a fixed spacing between the edge of the ceiling panel and the runners' vertical member. It is clear that four corner clips could be used as a substitute for the two corner clip arrangement.

The above corner clip and the following round clip are particularly useful as locking clips with a removable ceiling panel. Such a panel has two opposite sides that do not have a flange 17 above the kerf. Therefore, these two sides do not have the sides supported on the horizontal member 16 of a runner 12. The other two opposite sides have flanges 17 that rest on the horizontal member 16 to support those two sides, and therefore the ceiling panel, on the runners of the ceiling suspension system. The locking clips hold the ceiling panel in position so that the horizontal members are not disengaged from the panel.

Figure 2:
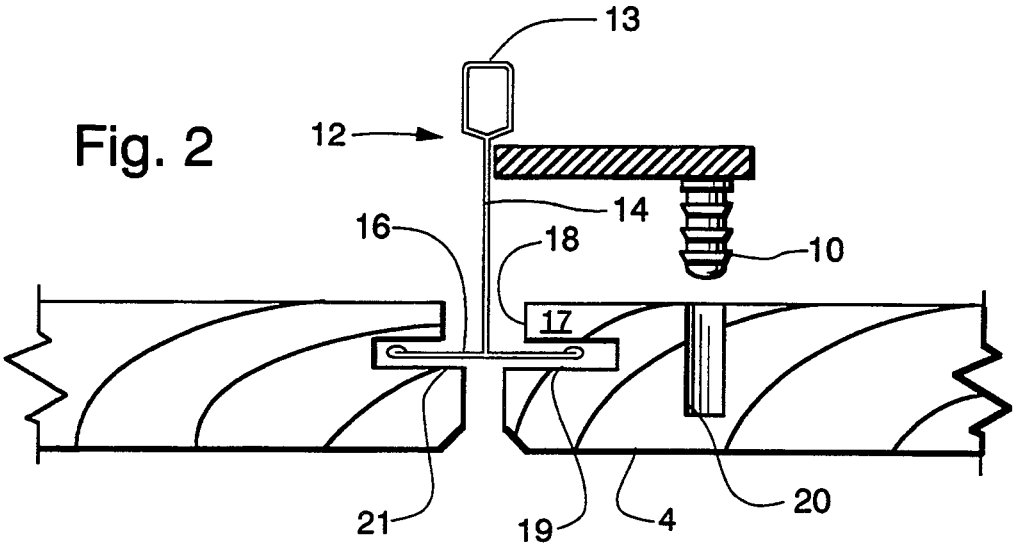
FIG. 2 is a cross-section view of the location of the corner clip relative the ceiling panel and the ceiling runner.
Figure 3:
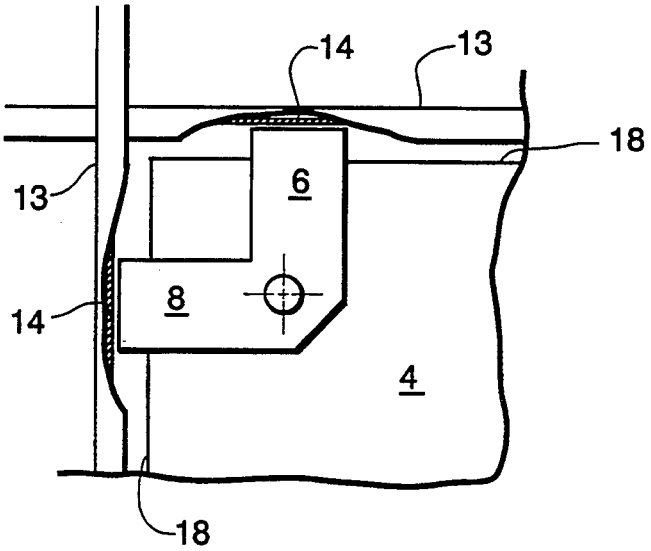
FIG. 3 is a top view of the corner clip in position.
Figure 7:
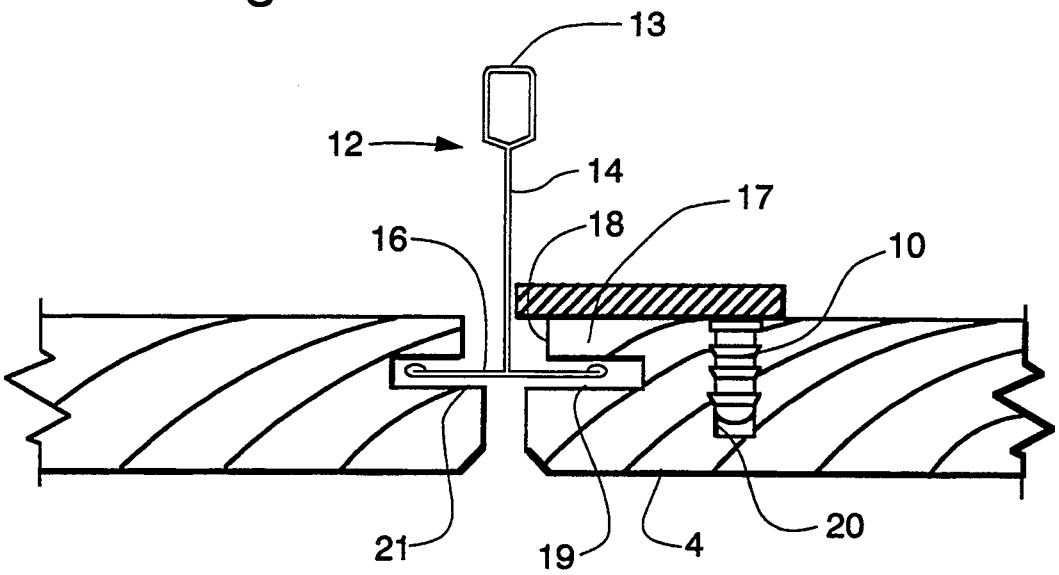
FIG. 7 is a cross-section view of the corner clip in position.
Figure 8:
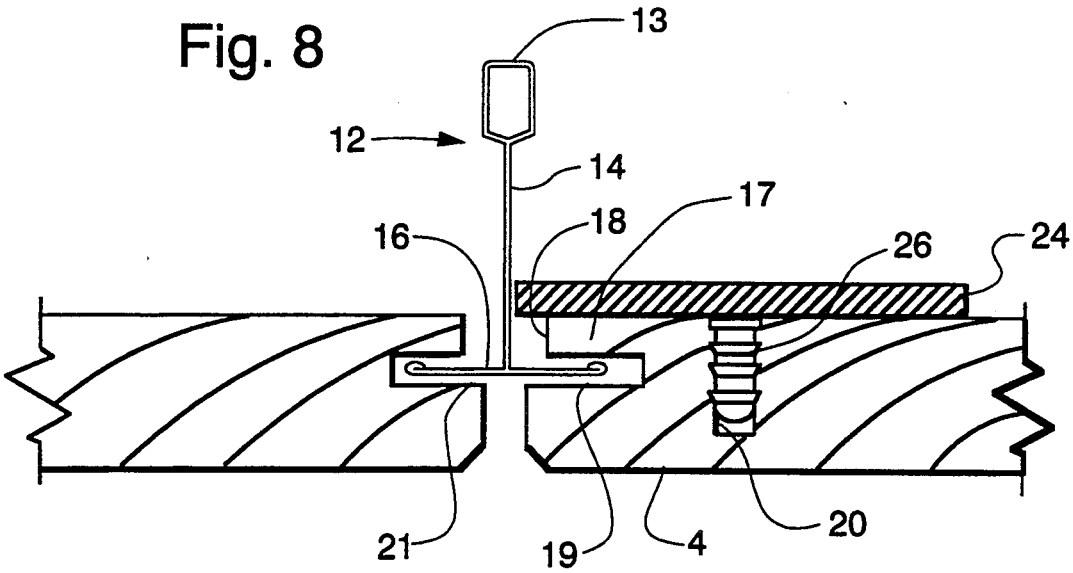
FIG. 8 is a cross-section view of the round clip in position.

FIG. 2 shows the kerf 19 which is on the left side of the ceiling panel 4. The depth of the kerf 21 on the right side of the adjacent ceiling panel is less than the depth of kerf 19. Kerf 21 would be the size of the kerf on the right side of ceiling panel 4. Each ceiling panel has a kerf 21 on one side and a kerf 19 on its opposite side. Because of the deeper kerf 19, the panel may be moved in the direction of the deeper kerf and this, in turn, will permit the kerf 21 to disengage from its runner horizontal member. Lowering the disengaged side below its horizontal member and moving the ceiling panel in the direction of the disengaged side will permit kerf 19 to disengage from its horizontal member. The corner and round clips placed on the side with the deeper kerf lock the ceiling panel in position and will prevent accidental movement of the ceiling panel in the direction of the deeper kerf and possible disengagement of the ceiling panel from its horizontal members.

FIGS. 4–6 show the use of the round disc clip. The round disc clip 22 is provided for ceiling panels which are supported in a suspended ceiling system. At least one disc clip is used on one side of the ceiling panel. The disc clip is a flat circular structure 24. From the center of the disc, a ringed post 26 projects from the flat circular structure 24.

At least one ceiling panel 4 is provided in a suspended ceiling system. The suspended ceiling system is composed of four inverted T-shaped runners 12. Each runner has a bulb member 13, a vertical member 14 and a horizontal member 16. The ceiling panel is supported on the horizontal members of at least two opposite runners. It is desired that the ceiling panel have at least two edges 18 spaced from the vertical web 14 of the runners. The spacing of the edges of the ceiling panel from the vertical webs locates the ceiling panel so that it is fully supported on at least two opposite runner horizontal flanges. Along one side of the ceiling panel there is provided a hole 20 which is partly bored in the ceiling panel. Into the hole 20 there is inserted the ringed post 26 which will hold the disc clip in position. The edge 28 of the flat circular structure 24 contacts the vertical member 14 of the adjacent runner to maintain a fixed spacing between the edge 18 of the ceiling panel 4 and the runner vertical member. Two disc clips could be used on one edge of the ceiling panel near each end of the panel edge. With a removable ceiling panel, the disc clip is placed on the side of the panel with the deeper kerf.

What is claimed is:

1. A locking clip in combination with a ceiling panel for use with a suspended ceiling system comprising:

(a) said locking clip being a flat base formed with at least one edge and a ribbed post projecting from the base;

(b) at least one ceiling panel and a suspension system for the ceiling panel comprising four inverted T-shaped runners, each said runner having a vertical member and a horizontal member, said ceiling panel being supported on the horizontal members of at least two runners and the ceiling panel having four edges and four corners, said edges being spaced from the vertical members of the four runners, adjacent at least one edge of the ceiling panel a hole being partially bored in the ceiling panel; and (c) at least one locking clip having its ribbed post inserted into the hole, said edge of the locking clip contacts the vertical member of an adjacent runner to maintain the spacing of the edge of the ceiling panel from the runner vertical member.

2. A locking clip as defined in claim 1 wherein:

(a) the locking clip is a flat right angle shaped base with two arms, adjacent the intersection of the two arms the ribbed post is positioned;

(b) the hole is positioned along one edge adjacent at least two corners of the edge of the ceiling panel; and (c) two locking clips are positioned into each of the two holes and the arms of the locking clip contact the vertical member of two adjacent runners.

3. A locking clip as defined in claim 2 wherein:

(a) four locking clips are in use, one at each corner of the ceiling panel.

4. A locking clip as defined in claim 1 wherein:

(a) the locking clip is a flat round disc with the ribbed post projecting from the center of the round disc;

(b) the hole is positioned along one side of the ceiling panel; and (c) the locking clip ribbed post is positioned into the hole and the edge of the round disc contacts the vertical member of the adjacent runner.

5. A locking clip as defined in claim 4 wherein:

(a) two locking clips are in use, both along one edge of the ceiling panel and each adjacent the ends of said edge.

* * * * *